US007671287B2

(12) United States Patent
Lai et al.

(10) Patent No.: US 7,671,287 B2
(45) Date of Patent: Mar. 2, 2010

(54) AUTOMATIC TIMING CONTROL DEVICE CASE

(75) Inventors: Keng-Jen Lai, Hsinchu (TW); Ming-Teng Chu, Hsinchu (TW); Shih-Chi Chan, Hsinchu (TW)

(73) Assignee: Norm Pacific Automation Corp., Hsinchu (TW)

( * ) Notice: Subject to any disclaimer, the term of this patent is extended or adjusted under 35 U.S.C. 154(b) by 180 days.

(21) Appl. No.: 11/839,776

(22) Filed: Aug. 16, 2007

(65) Prior Publication Data

US 2009/0046540 A1 Feb. 19, 2009

(51) Int. Cl.
*H01H 7/08* (2006.01)

(52) U.S. Cl. ..... 200/38 R; 200/19 R; 368/220

(58) Field of Classification Search ..... 200/35–38 E, 200/19.01–33 D; 368/139, 107–108, 220; 307/141.4

See application file for complete search history.

(56) References Cited

U.S. PATENT DOCUMENTS

| | | | | | |
|---|---|---|---|---|---|
| 2,036,178 | A | * | 3/1936 | Lucia | 99/328 |
| 2,060,037 | A | * | 11/1936 | Cheney et al. | 455/172.1 |
| 2,309,040 | A | * | 1/1943 | Boemle | 200/37 R |
| 2,472,287 | A | * | 6/1949 | Durant | 200/33 R |
| 2,578,843 | A | * | 12/1951 | Scalise | 334/29 |
| 2,594,103 | A | * | 4/1952 | Ward | 307/141 |
| 2,689,363 | A | * | 9/1954 | Frye | 408/11 |
| 2,824,181 | A | * | 2/1958 | Gallagher et al. | 200/35 R |
| 2,871,938 | A | * | 2/1959 | Butler | 200/35 R |
| 2,915,120 | A | * | 12/1959 | Smith | 318/466 |
| 3,031,558 | A | * | 4/1962 | Euler | 219/489 |
| 3,207,866 | A | * | 9/1965 | Hicks | 200/38 DB |
| 3,582,580 | A | * | 6/1971 | Drachi | 200/38 R |
| 3,610,847 | A | * | 10/1971 | Houpt et al. | 200/38 R |
| 3,732,383 | A | * | 5/1973 | Voland et al. | 200/38 R |
| 3,737,595 | A | * | 6/1973 | Simmons et al. | 200/33 R |
| 4,103,119 | A | * | 7/1978 | Homan et al. | 200/35 R |
| 4,166,206 | A | * | 8/1979 | Deane et al. | 200/293 |
| 4,307,270 | A | * | 12/1981 | Smock | 200/38 R |
| 4,485,281 | A | * | 11/1984 | Voland et al. | 200/38 R |
| 4,490,589 | A | * | 12/1984 | Voland | 200/38 R |
| 4,491,710 | A | * | 1/1985 | Smock | 200/303 |
| 4,503,295 | A | * | 3/1985 | Whitten, Jr. | 200/35 R |
| 4,538,037 | A | * | 8/1985 | Amonett | 200/38 R |
| 4,835,349 | A | * | 5/1989 | Weber | 200/38 R |
| 5,138,120 | A | * | 8/1992 | Adams | 200/38 R |
| 5,990,426 | A | * | 11/1999 | Amonett | 200/38 R |
| 6,583,372 | B1 | * | 6/2003 | Amonett | 200/38 R |
| 6,838,628 | B2 | * | 1/2005 | Amonett et al. | 200/300 |
| 6,917,001 | B2 | * | 7/2005 | Muroi et al. | 200/38 D |

* cited by examiner

*Primary Examiner*—Renee S Luebke
*Assistant Examiner*—Lisa Klaus
(74) *Attorney, Agent, or Firm*—Morris, Manning & Martin LLP; Tim Tingkang Xia

(57) ABSTRACT

An automatic timing control device case which is used for accommodating a timing control rotation shaft and a plurality of switches. A motor is disposed on the case for driving a gear set connected to the timing control rotation shaft to rotate, thereby controlling on or off of the switches through the timing control rotation shaft. The automatic timing control device case includes a body and a gear box. The body has an accommodation space for accommodating the timing control rotation shaft and the plurality of switches. The gear box is integrally formed in the body for accommodating the gear set. The gear box has at least one through-hole communicating the gear box and the accommodation space, such that the gear set is connected to and drives the timing control rotation shaft.

3 Claims, 5 Drawing Sheets

AUTOMATIC TIMING CONTROL DEVICE CASE

BACKGROUND OF THE INVENTION

1. Field of Invention

The present invention relates to an automatic timing control device case. More particularly, the present invention relates to a case on which a gear box is disposed by integrally forming.

2. Related Art

In a conventional art, for a timing control device, usually it is necessary to add or additionally dispose a gear box to drive a rotary disk or a rotary wheel in the timing control device, so as to achieve an effect of switching control. However, the added gear box requires additional metal punching parts, thereby generating additional cost of parts. Usually, the gear box is fixed on the timing control device by using locking elements, such as screws, so assembling process is complex. Meanwhile, the shake generated by rotation of the motor easily causes loose of the screw, which causes the gear box shift. The shift of the gear box damages components of the gear set, and even causes the whole gear box to fall off. Therefore, the conventional gear box assembling manner causes increased manufacturing cost and increased loss rate after using, and also results in inconvenience for manufacturers and users.

SUMMARY OF THE INVENTION

In view of the above problems, the present invention is directed to provide a design of disposing a gear box on a timing control device case by integrally forming, without additionally adding a metal punching part serving as the gear box, such that the part cost is reduced. Meanwhile, it is possible to prevent the disadvantage of increasing the manufacturing and assembling time caused by adding the gear box, and to prevent the gear box from loosing or falling off subsequently to result in puzzle of the user.

In order to achieve the above objective, the present invention provides an automatic timing control device case, which is used for accommodating a timing control rotation shaft and a plurality of switches. A motor is disposed on the case, for driving a gear set connected to the timing control rotation shaft to rotate, thereby controlling on or off of the switches through the timing control rotation shaft. The automatic timing control device case includes a body and a gear box. The body has an accommodation space for accommodating the timing control rotation shaft and the plurality of switches. The gear box is integrally formed in the body, and a bottom of the gear box has at least one through-hole for communicating the gear box and the accommodation space, such that the gear set is connected to and drives the timing control rotation shaft.

The advantage of the present invention is that the provided automatic timing control device case has the gear box integrally formed on the case. In the case manufacturing process, particularly when the case is fabricated by injection molding, the fabrication of the gear box is finished at the same time, such that the gear box is integrally formed on the case. Therefore, in the present invention, it is not necessary to additionally add the metal punching part to fabricate the gear box, and it is not necessary to cost time and manpower to assemble the gear box, so as to save the manufacturing cost, and meanwhile to prevent the gear box from falling off to be damaged.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

In order to have a further understanding of the objective, the construction, the feature, and the function of the present invention, the detailed description is given as follows with the embodiments.

Figure 1A:
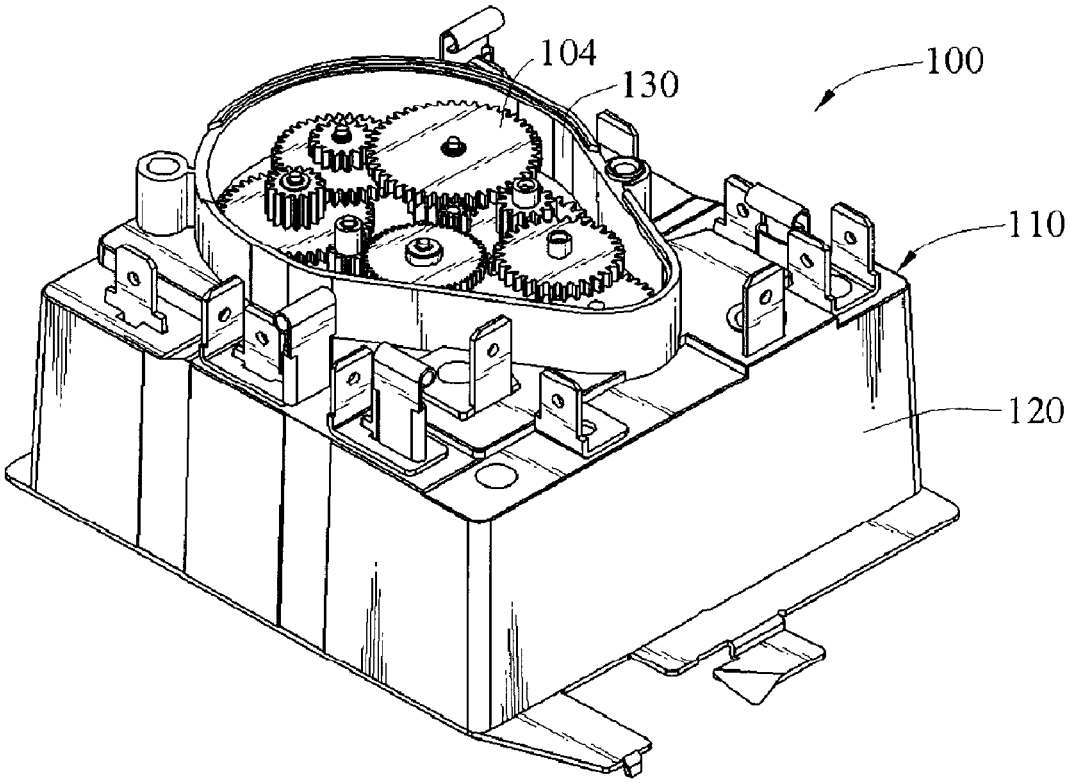
FIG. 1A is a stereogram of an automatic timing control device case having a gear set according to the present invention.
Figure 1B:
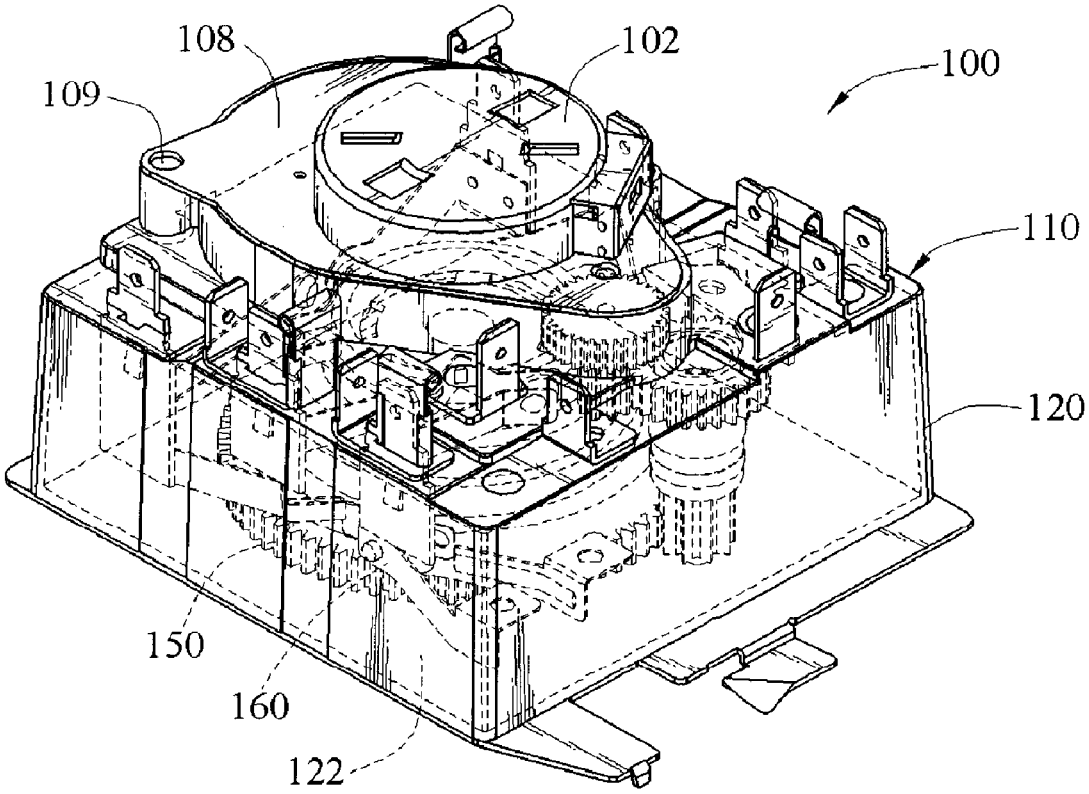
FIG. 1B is a stereogram of the automatic timing control device case having a cover according to the present invention.

First, referring to FIGS. 1A and 1B, the automatic timing control device case 110 of the present invention accommodates a timing control rotation shaft 150 and a plurality of switches 160, thereby constructing a timing control device 100. Generally, the timing control device 100 is applied in home appliances, such as a washing machine and a clothes dryer, but it is not limited here. The timing control device 100 further includes a motor 102 and a gear set 104, where the gear set 104 is connected to the timing control rotation shaft 150, and the motor 102 is used to drive the gear set 104, such that the timing control rotation shaft controls on or off of the plurality of switches 160 by notches formed on peripheral surface thereof, thereby achieving the timing control function of the timing control device 100.

Figure 1C:
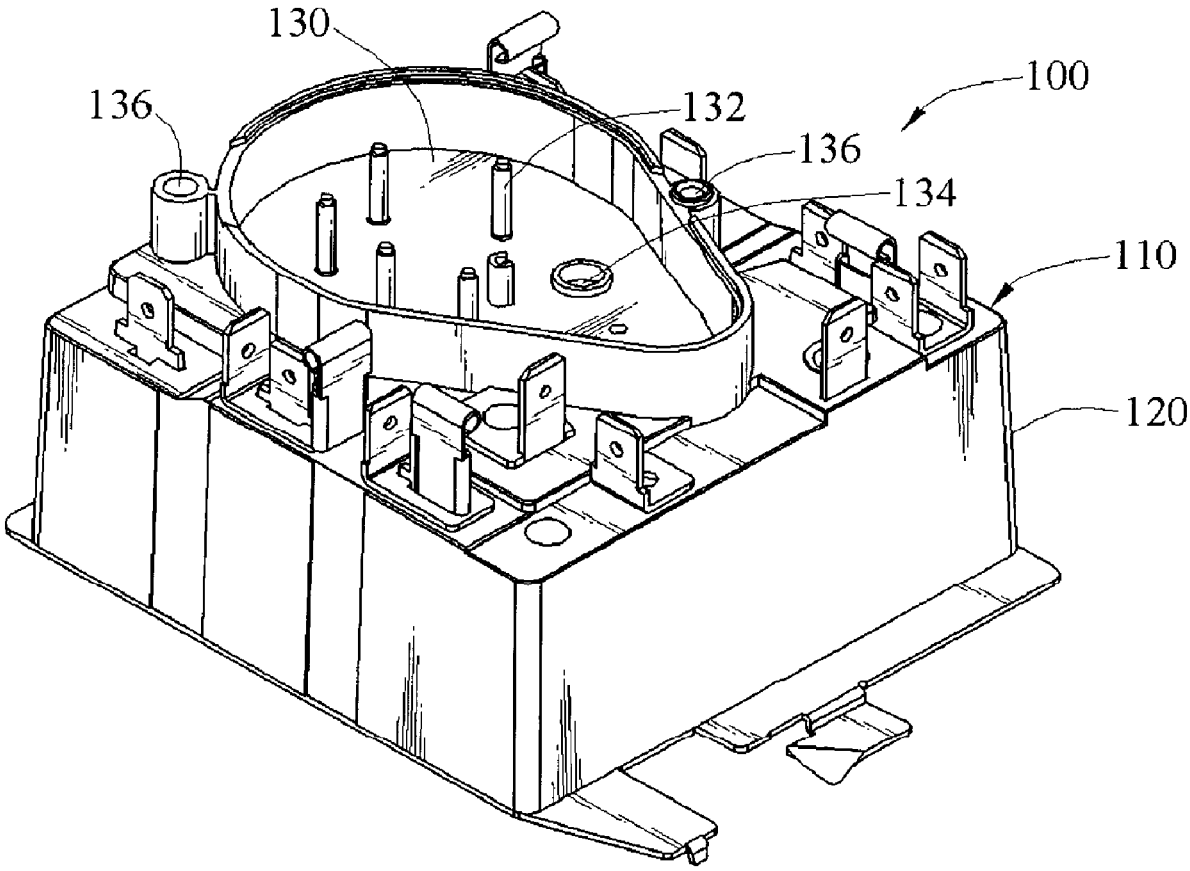
FIG. 1C is a stereogram of the automatic timing control device case according to a first embodiment of the present invention.

Next, referring to FIG. 1C, a stereogram of the automatic timing control device case according to a first embodiment of the present invention is shown. The automatic timing control device case 110 according to the first embodiment of the present invention includes a body 120 and a gear box 130. The body 120 has an accommodation space 122 for accommodating the timing control rotation shaft 150 and the plurality of switches 160.

Referring to FIG. 1C, the gear box 130 of the automatic timing control device case 110 is integrally formed on an outside bottom of the body 120. In this embodiment, the gear box 130 is a gear box 130 protruding from the body 120. The gear box 130 further has a plurality of gear columns 132 and two through-holes 134. The plurality of gear columns 132 is formed on the bottom of the gear box 130, so as to fix a plurality of gears, and to form a gear set 104 by mutually matching distances between the gear columns 132 and sizes of the gears.

The through-holes 134 of the gear box 130 can be used to connect the gear box 130 and the accommodation space 122 of the body 120, such that the gear set 104 contacts and drives the timing control rotation shaft 150 of the timing control device 100 through the through-holes 134.

Referring to FIGS. 1B and 1C, two tapped holes 136 are formed on an edge of the gear box 130. A cover 108 is fixed on the gear box 130 through the two tapped holes 136, so as to protect the gear set 104 in the gear box 130. The motor 102 is disposed on the cover 108, for driving the gear set 104 in the gear box 130.

Figure 2:
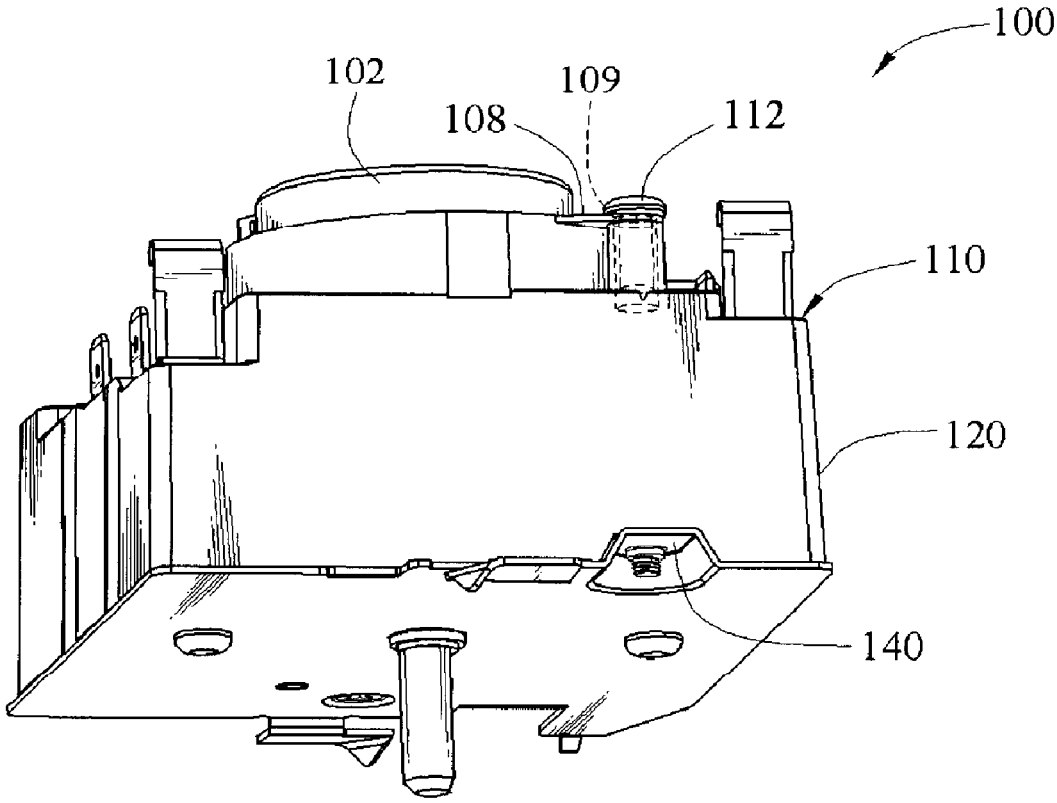
FIG. 2 is a side view of the automatic timing control device case according to a second embodiment of the present invention.

Next, referring to FIG. 2, a side view of the automatic timing control device case according to a second embodiment of the present invention is shown. In the second embodiment, the cover 108 having the motor 102 is made of a conductive material, for example metal. The cover 108 has a hole 109 corresponding to the tapped hole 136, and the tapped hole 136 penetrates through upper and lower sides of the body 120. The cover 108 is fixed on the body 120 by allowing a screw 112 to pass through the hole 109 and be locked in the tapped hole 136. The screw 112 passes through the tapped hole 136 and contacts the cover 108, such that the cover 108 is electrically connected to the screw 112. The screw 112 further penetrates through the body 120 and contacts a metal base plate 140, so that the screw 112 is grounded.

Figure 3:
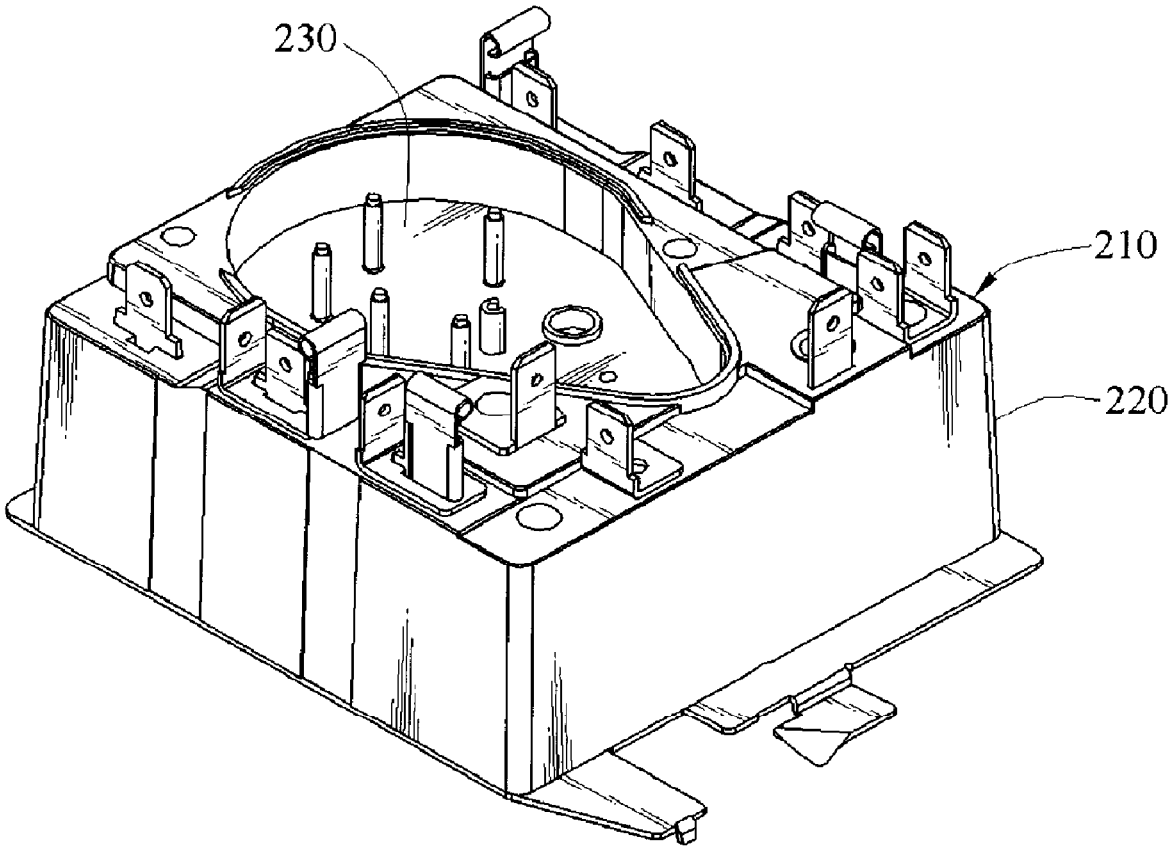
FIG. 3 is a stereogram of the automatic timing control device case according to a third embodiment of the present invention.

Next, referring to FIG. 3, a stereogram of the automatic timing control device case according to a third embodiment of the present invention is shown. An automatic timing control device case 210 according to the third embodiment of the present invention is similar to that of the first embodiment, and also has a body 220 and a gear box 230. However, the main difference is that the gear box 230 of the automatic timing control device case 210 in the third embodiment is depressed on an outside bottom of the body 220. Similarly, a gear set 104 is assembled in the gear box 230, for driving the timing control device 100.

In the automatic timing control device case of the present invention, the gear box for driving the timing control device is disposed on the case by integrally forming. The manufacturer can conveniently perform injection molding and can assemble the gear box without costing time and manpower, so as to save the manufacturing cost, and the user will not encounter the problem that the gear box falls off to be damaged.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An automatic timing control device case, for accommodating a timing control rotation shaft and a plurality of switches, having a motor disposed thereon for driving a gear set connected to the timing control rotation shaft to rotate, thereby controlling on or off of the switches through the timing control rotation shaft, comprising:

a body, having an accommodation space, for accommodating the timing control rotation shaft and the switches; and a gear box, integrally formed on the body, for accommodating the gear set, wherein a bottom of the gear box has at least one through-hole communicating the gear box and the accommodation space, such that the gear set connects to and drives the timing control rotation shaft, wherein a cover is further disposed on the near box, for covering the near box, and wherein at least one tapped hole is further formed on an edge of the gear box, for fixing the cover.

2. The automatic timing control device case as claimed in claim 1, wherein the gear box further comprises a plurality of gear columns, for fixing and matching a plurality of gears to form the gear set.

3. The automatic timing control device case as claimed in claim 1, wherein the gear box is extended and protruded from an outside bottom of the body.

* * * * *